US007637237B2

(12) United States Patent
Evans et al.

(10) Patent No.: US 7,637,237 B2
(45) Date of Patent: Dec. 29, 2009

(54) SWITCHABLE DOUBLE TAPPET

(75) Inventors: Matthew Evans, Warren, MI (US); Florin Bugescu, Canton, MI (US)

(73) Assignee: Schaeffler KG, Herzogenaurach (DE)

( * ) Notice: Subject to any disclaimer, the term of this patent is extended or adjusted under 35 U.S.C. 154(b) by 198 days.

(21) Appl. No.: 11/949,875

(22) Filed: Dec. 4, 2007

(65) Prior Publication Data

US 2009/0173302 A1 Jul. 9, 2009

Related U.S. Application Data

(60) Provisional application No. 60/868,386, filed on Dec. 4, 2006.

(51) Int. Cl.
*F01L 1/14* (2006.01)

(52) U.S. Cl. ..... 123/90.48; 123/90.16; 123/90.44; 123/90.52; 74/569

(58) Field of Classification Search ..... 123/90.16, 123/90.27, 90.31, 90.39, 90.44, 90.45, 90.48, 123/90.52, 90.55, 90.56; 74/559, 567, 569
See application file for complete search history.

(56) References Cited

U.S. PATENT DOCUMENTS 7,363,894 B2 * 4/2008 Evans et al. ..... 123/90.16

* cited by examiner

*Primary Examiner*—Ching Chang
(74) *Attorney, Agent, or Firm*—Volpe and Koenig, P.C.

(57) ABSTRACT

A switchable double tappet (1) is provided, especially for a tappet-push rod valve train of an internal combustion engine, with a cylindrical housing (2), which is arranged so that it oscillates via its outer casing (3) in a guide (4) in the internal combustion engine side and which has a bore (5) on the camshaft side, in which an inner element (6) moves axially relative to this borehole, wherein, on one side, a cam contact surface (10) is intrinsic to this inner element on its end projecting past an edge (7) of the borehole (5) or lower head (9) running in the region of the edge (7) and also, on the other side, at least one coupling slide (11) is intrinsic in its interior in the decoupled case, and this coupling slide can be displaced partially for a coupled case in or under a respective catch surface (12) of the housing (2), wherein between an upper head (13) of the inner element (6) facing away from the lower head (9) and a lower side (14) of a crossbar (15) of the housing (2), at least one lost-motion spring (16) is tensioned and, in a borehole (17) of the housing (2) away from the camshaft, above the crossbar (15), there are two supports (18) lying next to one another, on each of which an end of a tappet push rod can be supported.

12 Claims, 1 Drawing Sheet

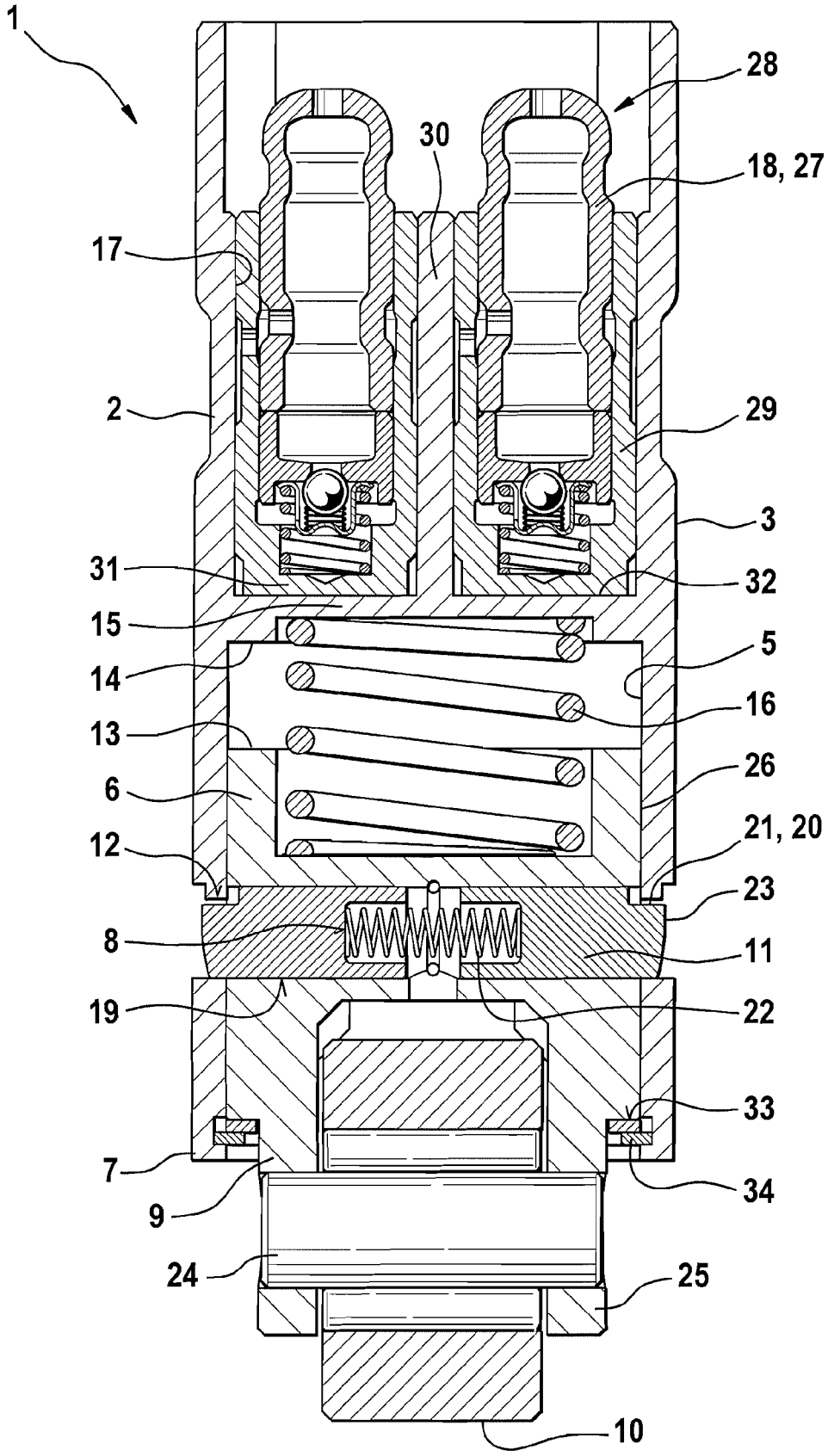
1
28
30
18, 27
17
2
29
3
31
32
15
5
14
16
13
26
6
21, 20
12
23
8
11
19
22
33
7
34
9
24
25
10

SWITCHABLE DOUBLE TAPPET

CROSS-REFERENCE TO RELATED APPLICATIONS

This application claims the benefit of U.S. Provisional Application No. 60/868,386, filed Dec. 4, 2006, which is incorporated herein by reference as if fully set forth.

BACKGROUND

The invention relates to a switchable valve train element, in particular a switchable valve train element, such as a tappet in a tappet-push rod valve train, with a cylindrical housing that can be arranged so that it oscillates via its outer casing in a guide on the side of the internal combustion engine, and a borehole with an inner element, which can move axially relative to this borehole and which can be coupled selectively with the housing by a coupling slide for achieving a large valve stroke, wherein when decoupled, preferably a zero valve stroke is generated.

Such switchable valve train elements are sufficiently well known to those skilled in the art. For example, if several identically acting gas-exchange valves for each cylinder are to be deactivated, then in the state of the art a switchable tappet is provided for each tappet push rod. Consequently, each tappet requires a separate guide with separate hydraulic medium supply. In addition, the camshaft for each tappet must have a raised cam section. Thus, the construction named above is rather complicated and unnecessarily requires a lot of installation space, as well as assembly expense.

SUMMARY

Therefore, the object of the invention is to create a tappet of the type noted above, in which the cited disadvantages are eliminated.

This object is met by a tappet according to the invention. Accordingly, a double tappet is provided, which joins two supports for tappet push rods in one housing, wherein, in a camshaft-side borehole of the housing, an inner element can move in the axial direction relative to this borehole. On one side, a cam contact surface and also, on the other side, in its interior at least one coupling slide in the decoupled state are intrinsic to this inner element. This coupling slide can be displaced partially for a coupled state in or under a respective catch surface of the housing, wherein according to the invention it is also provided to tension at least one lost-motion spring between an upper head of the inner element facing away from the lower head and a bottom side of a crossbar of the housing.

Through the construction noted above, the disadvantages cited above can be effectively eliminated. The housing diameter must be increased not at all or only slightly in comparison with prior housings of tappets for applying pressure to only one tappet push rod. Optionally, more than two supports are also conceivable and provided in the housing, for example, three supports, wherein then three identically acting gas-exchange valves can be actuated simultaneously.

Optionally, the double tappet proposed according to the invention can also be used for a valve train with a camshaft arranged laterally, in which only a very short tappet push rod or even no support is present, so that the corresponding support can then act, for example, directly on a bottom side of a finger lever.

As the cam contact surface, in one embodiment of the invention, at least one bearing-supported or bushing-supported roller is provided. Optionally, in this region a sliding tap is also possible, wherein for this purpose, cylindrical or domed constructions are offered.

The roller just noted runs preferably on a bolt, which is attached to tab-like sections extending from the lower head of the inner element. Optionally, in this region a completely surrounding housing section is also conceivable.

As a lost-motion spring, at least one helical compression spring is proposed, wherein, in general, spring assemblies are imagined. For minimizing the installation space, the helical compression spring can be placed in a pocket-like recess on the upper head of the inner element.

In addition, in one realization of the invention, it is provided to apply two pistons or the like as coupling slides that are diametrically opposed in a radial borehole of the inner element. As a counter surface for the coupling on the inner casing of the housing, here an annular groove can be provided, but an engagement of the piston in corresponding boreholes/passage holes or annular segments is also conceivable. At least in the case of the annular groove, the pistons can be constructed at each of their upper sides with flattened step sections, so that a low Hertzian stress is generated in the coupled case.

Optionally, for the solution provided here according to the invention, a coupling via a slide assembly or a coupling via only one coupling slide could also be imagined.

In continuation of the invention, it is proposed to displace the coupling slide in its coupling direction by the force of at least one compression spring, wherein a displacement in its decoupling direction is provided by hydraulic medium fed in front of its outer casing. Optionally, its displacement in the coupling direction can also be implemented by hydraulic medium pressure and in the decoupling direction by a spring force, wherein two-sided pressurization by hydraulic medium pressure is also conceivable and provided. In addition, additional servo controls, such as magnetic, electromagnetic controls, etc., are also offered for adjustments.

It is especially advantageous when the supports are constructed as pressure pistons of hydraulic backlash compensating elements of a known construction (for example, of hydraulic support elements known from mass production). These pressure pistons should then run in boreholes of guide sleeves arranged above, for example, the approximately central crossbar. The bases of these guide sleeves then preferably lie opposite an upper side of the crossbar named above.

For the simple arrangement and attachment of guide sleeves, it is proposed to arrange these, for example, in eyeglasses-shaped transverse guides in the upper part of the housing.

The housing and the inner element can also have a geometry that deviates from a cylindrical shape.

Preferably, the supports or pressure pistons of the hydraulic backlash elements should be arranged in the housing adjacent to each other so that their connecting line runs parallel to the axial line of the bolt or parallel to the camshaft axial line.

BRIEF DESCRIPTION OF THE DRAWING

The invention is explained in more detail with reference to an illustrated embodiment. Shown is a single FIGURE of a longitudinal section through a double tappet according to the invention.

DETAILED DESCRIPTION OF THE PREFERRED EMBODIMENT

A switchable double tappet 1 is shown, which is used, in particular, for pressurizing two identically acting gas-exchange valves in a tappet push rod valve train of an internal combustion engine. The double tappet 1 has a cylindrical housing 2, which can be arranged so that it oscillates via its outer casing 3 in a guide connected to the internal combustion engine. The housing 2 can be provided on its outer casing 3 with rotational locking means, such as flattened sections or projecting pins, etc.

The double tappet 1 is divided by a crossbar 15 approximately in the region of the center. A borehole 5 runs underneath the crossbar 15. An internal element 6 with its outer casing 26 is arranged so that it can move axially in this borehole. The inner element 6 has, on the camshaft side (here axially at the bottom) a lower head 9, from which two tab-like sections 25 hang. Between these sections 25, a bearing-supported roller is here applied as a cam contact surface 10, which is arranged on a bolt 24 running in the sections 25, and at least one lost-motion spring 16 (helical compression spring) is tensioned between an upper head 13 of the inner element 6 and a lower side 14 of the crossbar 15.

As can be further seen, the inner element 6 has a radially extending transverse borehole 19 (optionally, a secant-like or similar profile is also conceivable). Two diametrically opposed coupling slides 11 run in this borehole. These are pressurized radially outward (in the coupling direction) by the force of at least one compression spring 22, which acts against the inner sides 8. In the region of the outer sides 23, the coupling slides 11 have a flattened (stepped) contact surface 21 on their upper side 20. This contact surface engages with a catch surface 12 in or on the housing 2 in the illustrated coupling state of the double tappet 1. This catch surface 12 can be formed as a borehole, annular groove, or annular segment.

Axially above the crossbar 15 running approximately in the center here there are two supports 18 for the ends of tappet push rods or bottom sides of finger levers. These supports 18 are preferably constructed as pressure pistons 27 of hydraulic backlash compensating elements 28 and run in corresponding guide sleeves 29, whose bases 31 here lie directly on the upper side 32 of the crossbar 15.

For the simple guiding of the guide sleeves 29 relative to an upper borehole 17 in the housing 2, there is a transverse guide 30, which projects through the housing 2 and which can be connected, for example, in one piece with the housing 2.

In the case of a desired shutdown, hydraulic medium is led in front of the outer sides 23 of the coupling slides 11 (base circle phase) so that these are displaced radially inward against the force of the compression spring 22. When the cam lifts, the inner element 6 completes a return stroke motion relative to the housing 2 and the relevant two gas-exchange valves remain closed.

LIST OF REFERENCE SYMBOLS

1 Double tappet
2 Housing
3 Outer casing
4 Not assigned
5 Borehole
6 Inner element
7 Edge
8 Inner side
9 Lower head
10 Cam contact surface
11 Coupling slide
12 Catch surface
13 Upper head
14 Bottom side
15 Crossbar
16 Lost-motion spring
17 Borehole
18 Support
19 Transverse borehole
20 Upper side
21 Contact surface
22 Compression spring
23 Outer side
24 Bolt
25 Section
26 Outer casing
27 Pressure piston
28 Backlash compensating element
29 Guide sleeve
30 Transverse guide
31 Base
32 Upper side
33 Annular shoulder
34 Stop means

The invention claimed is:

1. A switchable double tappet for a valve train of an internal combustion engine, comprising a cylindrical housing, having an outer casing that can be arranged for oscillation in a guide of the internal combustion engine, the housing has a borehole on the camshaft side, in which an inner element can move axially relative to the borehole, a cam contact surface is provided a lower head of the inner element and projects past an edge of the borehole or extends to a region of the edge, on the other side, at least one coupling slide is located in an interior of the inner element in a decoupled state, and the coupling slide is displaceable for a coupled state in or under a respective catch surface of the housing, between an upper head of the inner element facing away from the lower head and a lower side of a crossbar of the housing, at least one lost-motion spring is tensioned, and in a borehole of the housing facing away from the camshaft above the crossbar, there are two supports located next to one another, on each of which one end of a tappet push rod can be supported.

2. A switchable double tappet according to claim 1, wherein the coupling slide comprises two pistons extending in a transverse borehole in the inner element that are diametrically opposed to one another, and which can be extended for the coupled state into a borehole or peripheral groove which forms the catch surface in the borehole of the housing.

3. A switchable double tappet according to claim 2, wherein the coupling slides are constructed with stepped upper sides for contact with an upper contact surface of the borehole or peripheral groove.

4. A switchable double tappet according to claim 2, wherein the coupling slides are displaceable in a coupling direction by at least one compression spring that contacts inner sides of the slides and are displaceable in a decoupling direction by hydraulic medium that fed to outer sides thereof.

5. A switchable double tappet according to claim 1, wherein a bearing-supported or bushing-supported roller running on a bolt is provided as a cam contact surface.

6. A switchable double tappet according to claim 5, wherein the bolt is held at ends thereof on a tab-like section extending from the lower head of the inner element.

7. A switchable double tappet according to claim 5, wherein the supports are arranged in the housing located next to one another, such that a connecting line runs parallel to an axial line of the bolt or the double tappet can be installed in a guide, such that the connecting line runs between the supports parallel to the camshaft.

8. A switchable double tappet according to claim 1, wherein a rotational locking device extends between the inner element and the housing.

9. A switchable double tappet according to claim 8, wherein the rotational locking device is a pin-groove, ball-groove, or spring-groove connection or comprises complementary flattened sections of an outer casing of the inner element and the borehole of the housing.

10. A switchable double tappet according to claim 1, wherein for each of the supports there is a pressure piston as a component of a hydraulic backlash compensating element, each of the backlash compensating elements further comprises a guide sleeve, in which the pressure piston moves axially, and the guide sleeves are held in a transverse guide spanning the upper borehole of the housing and are supported with bases thereof at least indirectly opposite an upper side of the crossbar.

11. A switchable double tappet according to claim 1, wherein a region of the lower head of the inner element is stepped, and an annular shoulder communicates in the stepped region with a stop projecting from the borehole of the housing, and backlash of at least one of the coupling slides can also be selectively adjusted relative to its catch surface in the housing in the coupled state via the stop.

12. A switchable double tappet according to claim 11, wherein a variable thickness ring or two rings, of which at least one has a variable thickness, are provided as the stop.

* * * * *